US010414616B2

(12) United States Patent
Shin et al.

(10) Patent No.: US 10,414,616 B2
(45) Date of Patent: Sep. 17, 2019

(54) POST-PROCESSING APPARATUS AND IMAGE FORMING APPARATUS

(71) Applicant: FUJI XEROX Co., Ltd., Tokyo (JP)

(72) Inventors: Jeman Shin, Incheon (KR); Soonyoung Kwon, Incheon (KR); Kyungyeul Ryu, Incheon (KR)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 180 days.

(21) Appl. No.: 15/699,168

(22) Filed: Sep. 8, 2017

(65) Prior Publication Data

US 2018/0257896 A1 Sep. 13, 2018

(30) Foreign Application Priority Data

Mar. 8, 2017 (JP) ..... 2017-043792

(51) Int. Cl.

| | |
|---|---|
| ***B65H 31/26*** | (2006.01) |
| ***B65H 31/10*** | (2006.01) |
| ***B65H 31/18*** | (2006.01) |
| ***B41J 13/10*** | (2006.01) |
| ***B65H 37/04*** | (2006.01) |
| ***G03G 15/00*** | (2006.01) |

(52) U.S. Cl.

CPC ..... *B65H 31/26* (2013.01); *B65H 31/10* (2013.01); *B65H 31/18* (2013.01); *B65H 37/04* (2013.01); *G03G 15/6552* (2013.01); *B41J 13/106* (2013.01); *B65H 2403/41* (2013.01); *B65H 2403/732* (2013.01); *B65H 2801/06* (2013.01)

(58) Field of Classification Search

CPC ..... B41J 13/106; B65H 31/18

See application file for complete search history.

(56) References Cited

FOREIGN PATENT DOCUMENTS

| | | | |
|---|---|---|---|
| JP | 2006069746 A | * | 3/2006 |
| JP | 2015-016994 A | | 1/2015 |
| JP | 2015020813 A | * | 2/2015 |

* cited by examiner

*Primary Examiner* — Jennifer E Simmons

(74) *Attorney, Agent, or Firm* — Sughrue Mion, PLLC

(57) ABSTRACT

A post-processing apparatus includes a tray receiving an ejected recording medium, a moving mechanism vertically moving the tray, a driving source driving the moving mechanism, a member pressing, from vertically above, a recording medium ejected to the tray, a rotational-driving mechanism driving the member so that the member rotates in a first direction away from an apparatus body when the tray is moved upward by the moving mechanism and that the member rotates in a second direction toward the apparatus body when the tray is moved downward by the moving mechanism, a rotation-angle limiting unit limiting a rotation angle of the member when the member is driven to rotate in the first direction and to rotate in the second direction, and a rotational-force limiting mechanism idling when a rotational force not lower than a predetermined force is applied to the rotational-driving mechanism.

7 Claims, 6 Drawing Sheets

POST-PROCESSING APPARATUS AND IMAGE FORMING APPARATUS

CROSS-REFERENCE TO RELATED APPLICATIONS

This application is based on and claims priority under 35 USC 119 from Japanese Patent Application No. 2017-043792 filed Mar. 8, 2017.

BACKGROUND

(i) Technical Field

The present invention relates to a post-processing apparatus and an image forming apparatus.

(ii) Related Art

For example, in the case of ejecting a recording medium, such as a printing sheet, on which stapling has been performed to an ejection tray, if a printing sheet on which stapling has not been performed is stacked on the ejection tray, the printing sheet on which stapling has not been performed may sometimes be displaced.

In order to prevent such displacement of a printing sheet on an ejection tray, a configuration may sometimes be employed in which an ejected printing sheet is pressed from above by a pressing member, such as a set clamp, so as not to be displaced.

In the case of using such a set clamp, when a printing sheet is ejected from an ejection port, the set clamp needs to be moved and accommodated in an apparatus body so as not to hinder the printing sheet from being ejected.

However, using components including a dedicated driving source, such as a motor, for driving the set clamp, a position-detection sensor, and an electromagnetic clutch leads to an increase in the manufacturing costs.

SUMMARY

According to an aspect of the invention, there is provided a post-processing apparatus including an ejection tray receiving a recording medium that is ejected, a moving mechanism causing the ejection tray to move up and down in a vertical direction, a driving source driving the moving mechanism, a pressing member pressing, from above in the vertical direction, a recording medium ejected to the ejection tray, a rotational-driving mechanism driving the pressing member so that the pressing member rotates in a direction away from an apparatus body when the ejection tray is moved upward by the moving mechanism and that the pressing member rotates in a direction toward the apparatus body when the ejection tray is moved downward by the moving mechanism, a rotation-angle limiting unit limiting a rotation angle of the pressing member when the pressing member is driven so as to rotate in the direction away from the apparatus body and when the pressing member is driven so as to rotate in the direction toward the apparatus body, and a rotational-force limiting mechanism idling when a rotational force that is not lower than a predetermined force is applied to the rotational-driving mechanism.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail below with reference to the drawings.

Figure 1:
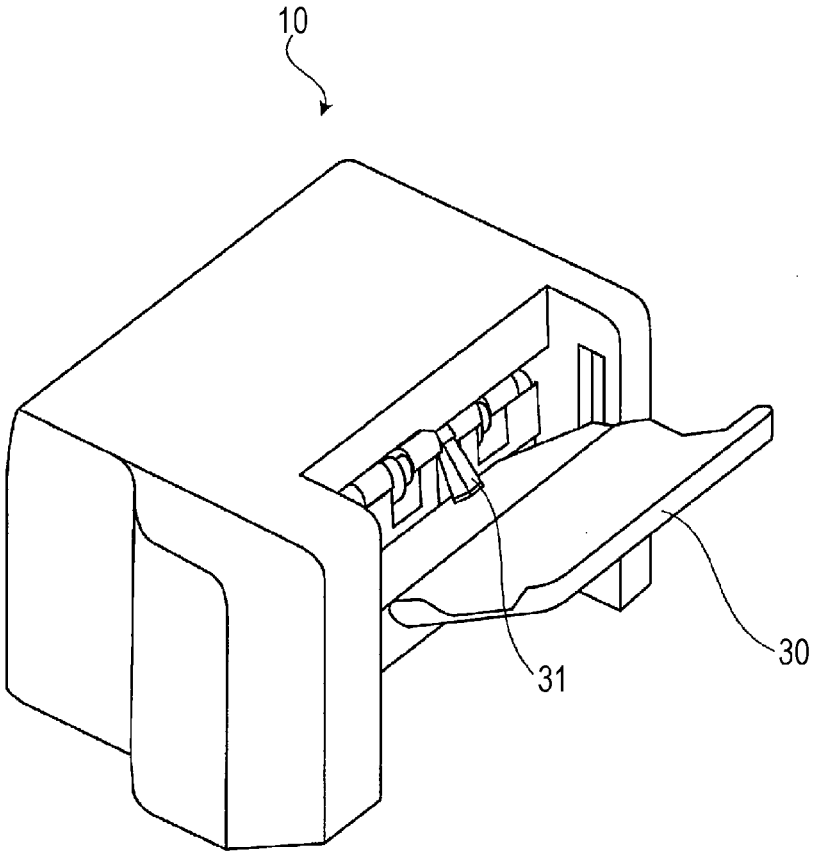
FIG. 1 is a perspective view illustrating the appearance of a post-processing apparatus according to an exemplary embodiment of the present invention.

FIG. 1 is a perspective view illustrating the appearance of a post-processing apparatus 10 according to an exemplary embodiment of the present invention.

As illustrated in FIG. 1, the post-processing apparatus 10 according to the exemplary embodiment of the present invention has a shape such that the post-processing apparatus 10 is used by being connected to a printer. The post-processing apparatus 10 has a function of performing post-processing, such as stapling, on plural printing sheets ejected from the printer and then ejecting a stack of the printing sheets, on which the post-processing has been performed, to an ejection tray 30.

Note that, in the post-processing apparatus 10, the ejection tray 30 is configured to be vertically movable. In the post-processing apparatus 10, a set clamp 31 that prevents printing sheets on the ejection tray 30 from being displaced by pressing the printing sheets is accommodated in an apparatus body, and the set clamp 31 is configured to project from the apparatus body and press the printing sheets on the ejection tray 30 when the ejection tray 30 moves upward.

Figure 2:
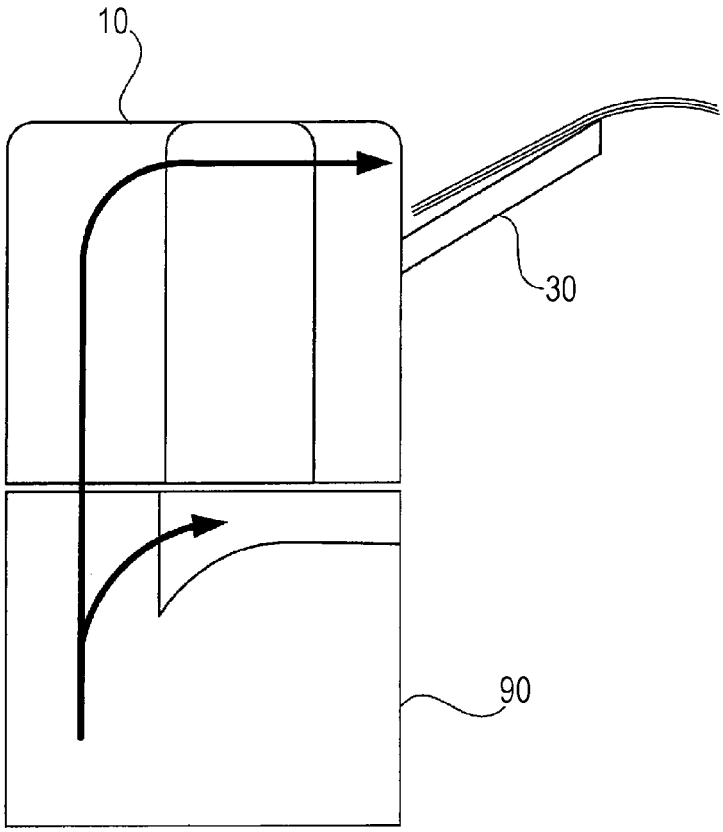
FIG. 2 is a diagram illustrating a state in which the post-processing apparatus according to the exemplary embodiment of the present invention is used by being connected to a printer.

A state in which the post-processing apparatus 10 is used by being connected to a printer 90 is illustrated in FIG. 2.

FIG. 2 illustrates a state in which the post-processing apparatus 10 ejects, to the ejection tray 30, a stack of printing sheets obtained by performing the post-processing, such as stapling, on printing sheets that are ejected from the printer 90 and introduced into the post-processing apparatus 10.

Figure 3:
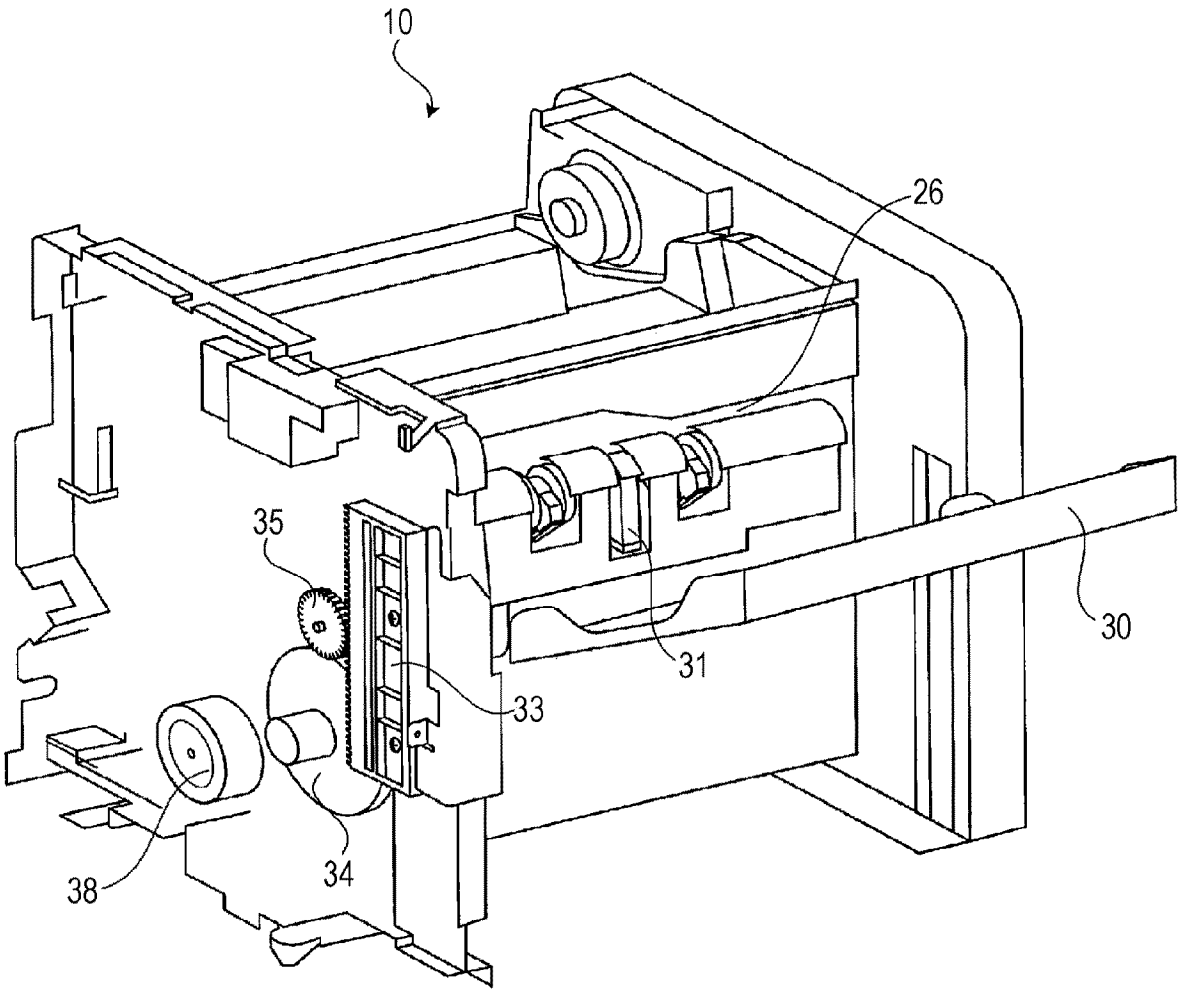
FIG. 3 is a perspective view illustrating the internal structure of the post-processing apparatus according to the exemplary embodiment of the present invention from which a side-surface covering and a top-surface covering have been removed.

FIG. 3 is a perspective view illustrating the internal structure of the post-processing apparatus 10 according to the present exemplary embodiment from which a side-surface covering and a top-surface covering have been removed.

FIG. 3 illustrates a structure for controlling vertical movement of the ejection tray 30 that receives a recording medium such as a printing sheet ejected from an ejection port 26. Referring to FIG. 3, a rack member 33, and gears 34 and 35 are illustrated as a moving mechanism that causes the ejection tray 30 to move up and down in the vertical direction. A motor 38 is provided as a driving source for driving the moving mechanism.

The ejection tray 30 is fixed to the rack member 33. When the motor 38 rotates, the gears 34 and 35 are driven so as to rotate. The rack member 33 has teeth that engage the gear (pinion gear) 35 and is configured to move in the vertical direction along with rotation of the gear 35.

The set clamp 31 is disposed in the vicinity of the center of a region below the ejection port 26 of the post-processing apparatus 10. The set clamp 31 is accommodated in the apparatus body when a printing sheet is ejected from the ejection port 26. The set clamp 31 is controlled such that, as the ejection tray 30 moves upward as a result of the ejected printing sheet being stacked on the ejection tray 30, the set clamp 31 projects from the apparatus body and presses the printing sheet on the ejection tray 30.

Although a case will be described in which the one set clamp 31 is disposed in the center of the apparatus body of the post-processing apparatus 10 according to the present exemplary embodiment, a configuration in which two set clamps 31 that operate in conjunction with each other press printing sheets on the ejection tray 30 may be employed.

Figure 4:
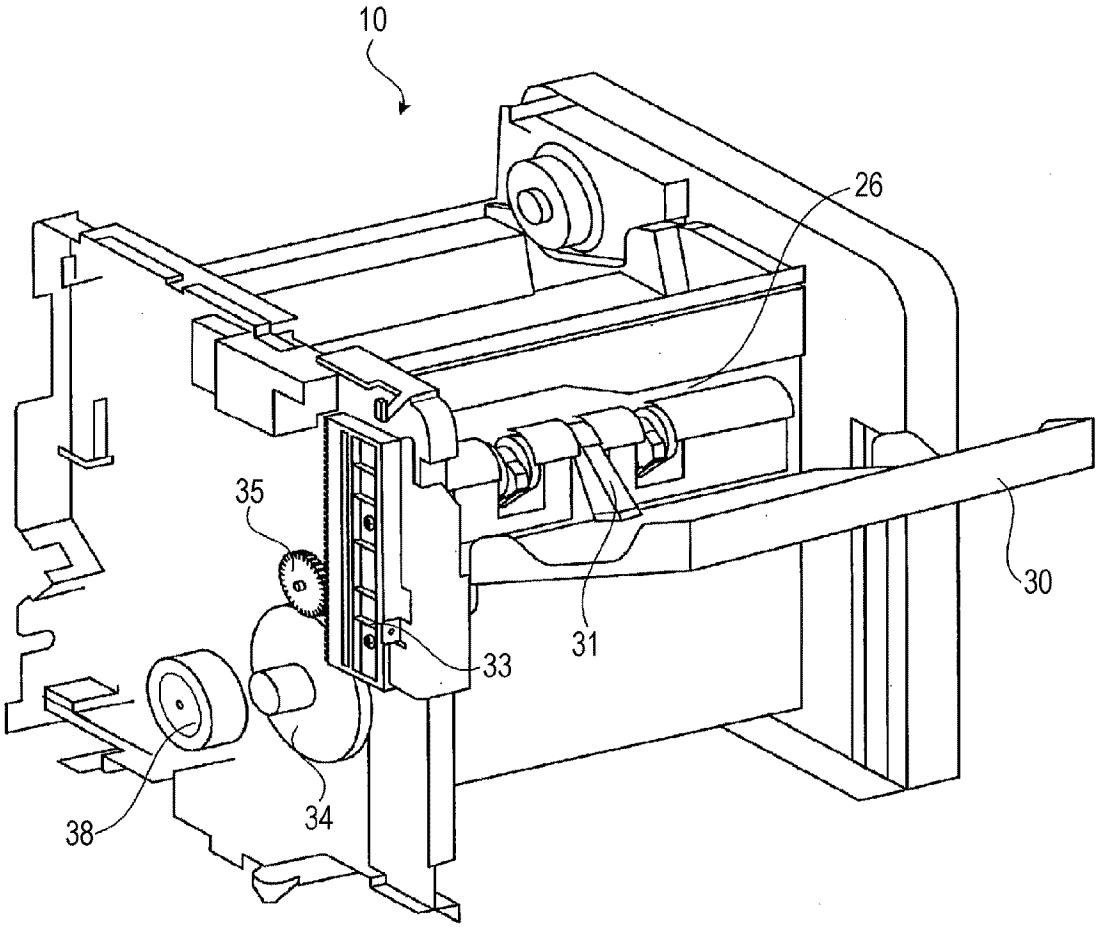
FIG. 4 is a diagram illustrating a state in which a set clamp projects from an apparatus body and presses printing sheets on an ejection tray.

A state in which the set clamp 31 projects from the apparatus body and presses printing sheets on the ejection tray 30 is illustrated in FIG. 4. FIG. 4 illustrates a state in which the set clamp 31 projects from the apparatus body as a result of rotating with upward movement of the ejection tray 30 in the vertical direction. The set clamp 31 is a pressing member that the presses printing sheets, which have been ejected to the ejection tray 30, from above in the vertical direction.

Figure 5:
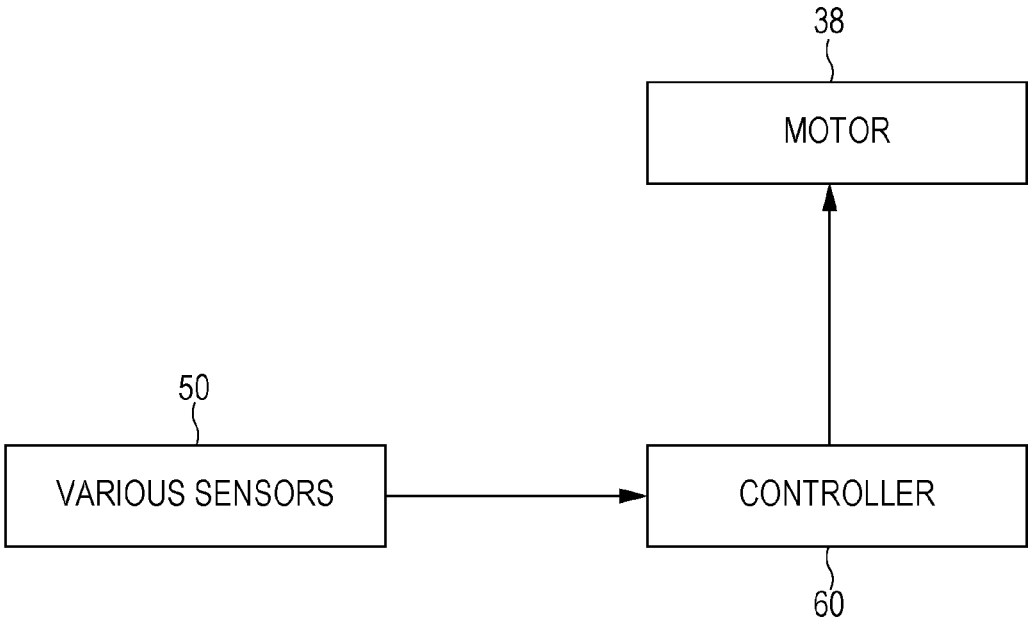
FIG. 5 is a diagram illustrating a configuration for controlling rotation of a motor, which is a driving source.

Although not illustrated in FIG. 3 and FIG. 4, the post-processing apparatus 10 includes various sensors 50 that detect, for example, the position of the ejection tray 30 and the ejection tray 30 reaching the uppermost position. As illustrated in FIG. 5, a controller 60 that controls various operations of the post-processing apparatus 10 controls rotation of the motor 38, which is a driving source, on the basis of detection signals from the various sensors 50.

Figure 6:
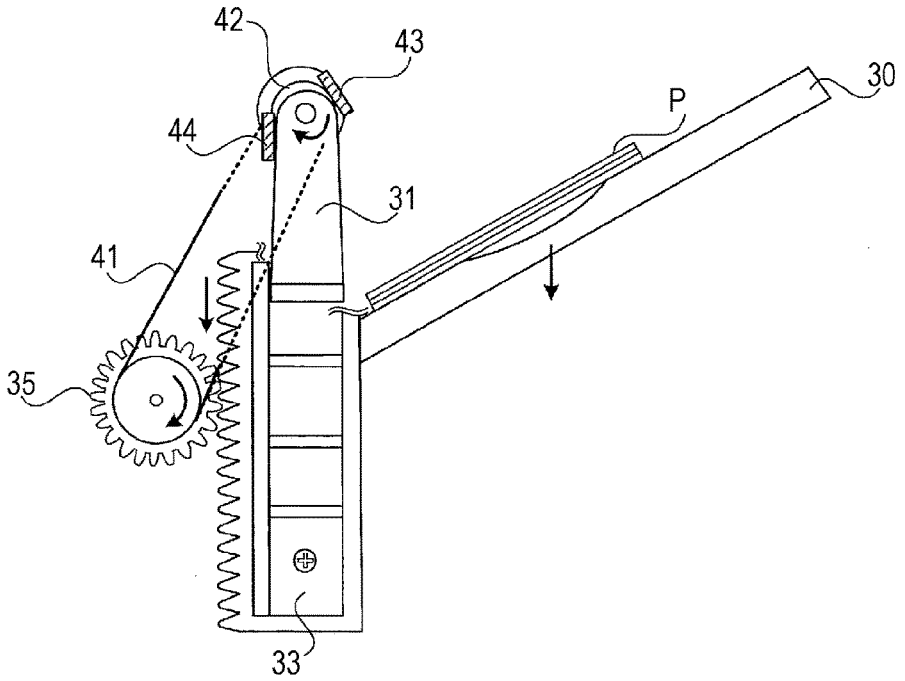
FIG. 6 is a diagram illustrating a specific configuration for driving the set clamp when the ejection tray moves downward.
Figure 7:
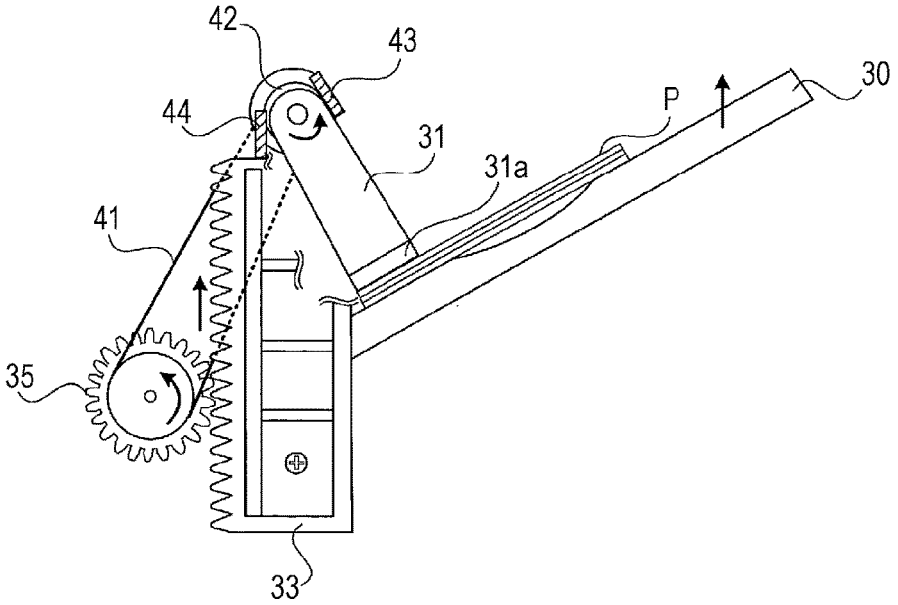
FIG. 7 is a diagram illustrating a specific configuration for driving the set clamp when the ejection tray moves upward.

A specific configuration for driving the set clamp 31 will now be described with reference to FIG. 6 and FIG. 7. In FIG. 6 and FIG. 7, a portion of the rack member 33 is not illustrated in order to improve the visibility of a driving mechanism of the set clamp 31.

As illustrated in FIG. 6 and FIG. 7, a belt (driving belt) 41 is stretched by the gear 35, which is used for causing the ejection tray 30 to move up and down, and the belt 41 is configured to drive a torque limiter 42 so that the torque limiter 42 rotates. Consequently, the torque limiter 42 is driven so as to rotate as the gear 35 rotates and causes the rack member 33 to move up and down. The set clamp 31 is attached to the torque limiter 42 and driven so as to rotate in a direction toward the apparatus body and a direction away from the apparatus body along with rotation of the torque limiter 42.

In other words, the gear 35, the belt 41, and the torque limiter 42 form a rotational-driving mechanism that drives the set clamp 31 so that the set clamp 31 rotates in the direction away from the apparatus body when the ejection tray 30 is moved upward by the moving mechanism, which includes the rack member 33, and that the set clamp 31 rotates in the direction toward the apparatus body when the ejection tray 30 is moved downward by the moving mechanism, which includes the rack member 33.

Note that the controller 60, which is illustrated in FIG. 5 and which controls the operation of the motor 38, performs control in such a manner that the motor 38 is driven in a direction in which the motor 38 causes the ejection tray 30 to move downward before a printing sheet is ejected and that the motor 38 is driven in a direction in which the motor 38 causes the ejection tray 30 to move upward after a printing sheet has been ejected.

A stopper 43 and a stopper 44 are disposed in front of and to the rear of the set clamp 31, respectively. The stopper 43 limits the rotation angle of the set clamp 31 when the set clamp 31 is driven so as to rotate in the direction away from the apparatus body, and the stopper 44 limits the rotation angle of the set clamp 31 when the set clamp 31 is driven so as to rotate in the direction toward the apparatus body.

In other words, each of the stoppers 43 and 44 functions as a rotation-angle limiting unit that limits the rotation angle of the set clamp 31 when the set clamp 31 is driven so as to rotate.

The torque limiter 42 functions as a rotational-force limiting mechanism that idles when a torque (rotational force) that is not lower than a predetermined torque is applied to the rotational-driving mechanism, which drives the set clamp 31 so that the set clamp 31 rotates.

Accordingly, when the ejection tray 30 moves downward, as illustrated in FIG. 6, the set clamp 31 is driven so as to rotate in the direction toward the apparatus body along with rotation of the gear 35, and when the set clamp 31 is brought into contact with the stopper 44, the set clamp 31 stops at the position at which the set clamp 31 is brought into contact with the stopper 44 as a result of the torque limiter 42 idling.

When the ejection tray 30 moves upward, as illustrated in FIG. 7, the set clamp 31 is driven so as to rotate in the direction away from the apparatus body along with rotation of the gear 35, and when the set clamp 31 is brought into contact with the stopper 43, the set clamp 31 stops at the position at which the set clamp 31 is brought into contact with the stopper 43 as a result of the torque limiter 42 idling.

Note that a damper 31*a*, which is an elastic member, is mounted on a surface of the set clamp 31, the surface coming into contact with a printing sheet, in such a manner as to prevent printing sheets ejected to the ejection tray 30 from being displaced.

When the damper 31*a* mounted on the surface of the set clamp 31, which comes into contact with a printing sheet, presses printing sheets on the ejection tray 30, the damper 31*a* accommodates the height deviation of the ejection tray 30 by extending and retracting by, for example, about 5 mm.

In the post-processing apparatus 10 according to the present exemplary embodiment, the vertical movement of the ejection tray 30 and the driving of the set clamp 31 so as to cause the set clamp 31 to rotate are controlled by one motor 38. Therefore, the driving of the set clamp 31 so as to cause the set clamp 31 to rotate with the vertical movement of the ejection tray 30 is achieved without requiring a dedicated motor for driving the set clamp 31 so that the set clamp 31 rotates, a sensor that detects the rotation position of the set clamp 31, and the like.

[Modification]

In the above-described exemplary embodiment, although a case has been described in which the present invention is applied to a post-processing apparatus, the present invention is not limited to such a post-processing apparatus. The present invention may also be applied to apparatuses, such as image forming apparatuses including printers and copying machines, each of which includes an ejection tray that receives an ejected printing sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

an ejection tray receiving a recording medium that is ejected;

a moving mechanism causing the ejection tray to move up and down in a vertical direction;

a driving source driving the moving mechanism;

a pressing member pressing, from above in the vertical direction, a recording medium ejected to the ejection tray;

a rotational-driving mechanism driving the pressing member so that the pressing member rotates in a direction away from an apparatus body when the ejection tray is moved upward by the moving mechanism and that the pressing member rotates in a direction toward the apparatus body when the ejection tray is moved downward by the moving mechanism;

a rotation-angle limiting unit limiting a rotation angle of the pressing member when the pressing member is driven so as to rotate in the direction away from the apparatus body and when the pressing member is driven so as to rotate in the direction toward the apparatus body; and a rotational-force limiting mechanism idling when a rotational force that is not lower than a predetermined force is applied to the rotational-driving mechanism.

2. The post-processing apparatus according to claim 1, wherein an elastic member is mounted on a surface of the pressing member, the surface coming into contact with a recording medium, and prevents a recording medium that has been ejected to the ejection tray from being displaced.

3. The post-processing apparatus according to claim 2, wherein, when the elastic member mounted on the surface of the pressing member, which comes into contact with a recording medium, presses a recording medium on the ejection tray, the pressing member accommodates height deviation of the ejection tray by extending and retracting.

4. The post-processing apparatus according to claim 3, further comprising:

a controller that performs control in such a manner that the driving source is driven in a direction in which the driving source causes the ejection tray to move downward before a recording medium is ejected and that the driving source is driven in a direction in which the driving source causes the ejection tray to move upward after a printing sheet has been ejected.

5. The post-processing apparatus according to claim 2, further comprising:

a controller that performs control in such a manner that the driving source is driven in a direction in which the driving source causes the ejection tray to move downward before a recording medium is ejected and that the driving source is driven in a direction in which the driving source causes the ejection tray to move upward after a printing sheet has been ejected.

6. The post-processing apparatus according to claim 1, further comprising:

a controller that performs control in such a manner that the driving source is driven in a direction in which the driving source causes the ejection tray to move downward before a recording medium is ejected and that the driving source is driven in a direction in which the driving source causes the ejection tray to move upward after a printing sheet has been ejected.

7. An image forming apparatus comprising:

an ejection tray receiving a recording medium that is ejected;

a moving mechanism causing the ejection tray to move up and down in a vertical direction;

a driving source driving the moving mechanism;

a pressing member pressing, from above in the vertical direction, a recording medium ejected to the ejection tray;

a rotational-driving mechanism driving the pressing member so that the pressing member rotates in a direction away from an apparatus body when the ejection tray is moved upward by the moving mechanism and that the pressing member rotates in a direction toward the apparatus body when the ejection tray is moved downward by the moving mechanism;

a rotation-angle limiting unit limiting a rotation angle of the pressing member when the pressing member is driven so as to rotate in the direction away from the apparatus body and when the pressing member is driven so as to rotate in the direction toward the apparatus body; and a rotational-force limiting mechanism idling when a rotational force that is not lower than a predetermined force is applied to the rotational-driving mechanism.

* * * * *